US007686355B2

(12) United States Patent
Jankowski et al.

(10) Patent No.: US 7,686,355 B2
(45) Date of Patent: Mar. 30, 2010

(54) ROTARY LOCKING MECHANISM FOR OUTSIDE VEHICLE DOOR HANDLE

(75) Inventors: Krystof P. Jankowski, Waterford, MI (US); Ehab Khalid Kamal, Novi, MI (US)

(73) Assignee: Intier Automotive Closures Inc, Newmarket , Ontario (CA)

( * ) Notice: Subject to any disclaimer, the term of this patent is extended or adjusted under 35 U.S.C. 154(b) by 650 days.

(21) Appl. No.: 11/578,033

(22) PCT Filed: May 2, 2005

(86) PCT No.: PCT/CA2005/000662

§ 371 (c)(1),
(2), (4) Date: Oct. 12, 2006

(87) PCT Pub. No.: WO2005/106167

PCT Pub. Date: Nov. 10, 2005

(65) Prior Publication Data

US 2007/0271974 A1 Nov. 29, 2007

Related U.S. Application Data

(60) Provisional application No. 60/566,980, filed on Apr. 30, 2004.

(51) Int. Cl.
*E05B 3/00* (2006.01)
*E05C 3/06* (2006.01)

(52) U.S. Cl. ..... 292/336.3; 292/216; 292/DIG. 22; 292/DIG. 65

(58) Field of Classification Search ..... 292/216, 292/336.3, DIG. 22, DIG. 65
See application file for complete search history.

(56) References Cited

U.S. PATENT DOCUMENTS 5,669,642 A * 9/1997 Kang ..... 292/336.3
6,042,159 A * 3/2000 Spitzley et al. ..... 292/216

(Continued)

FOREIGN PATENT DOCUMENTS

DE 19858416 * 6/2000

(Continued)

OTHER PUBLICATIONS

International Search Report & Written Opinion for PCT/CA2005/000662 Dated Aug. 26, 2005.

*Primary Examiner*—Carlos Lugo
(74) *Attorney, Agent, or Firm*—Clark Hill PLC

(57) ABSTRACT

A locking device is provided for preventing a motor vehicle door from opening when a handle portion of a handle assembly moves with acceleration above a predetermined threshold relative to a base thereof. The locking device includes a lock cup fixedly secured to the base and having a plurality of teeth. The locking device also includes a spool rotatably coupled to the lock cup and operably connected to the handle portion. The spool includes a pawl rotatably mounted thereto. The locking device further includes an inertia element disposed between the lock cup and the spool. The inertia element is coupled to the pawl such that upon the acceleration above the predetermined threshold the inertia element lags rotation of the spool and forces the pawl into engagement with one of the plurality of teeth to stop movement of the handle portion relative to the base and prevent the door from opening.

16 Claims, 7 Drawing Sheets

U.S. PATENT DOCUMENTS 6,062,613 A * 5/2000 Jung et al. ..... 292/201
6,113,161 A * 9/2000 Jung et al. ..... 292/216
6,209,932 B1 * 4/2001 Jung et al. ..... 292/216
6,241,294 B1 6/2001 Young et al.
6,447,030 B1 9/2002 Meinke
6,648,382 B1 11/2003 Monig et al.
6,942,260 B2 * 9/2005 Bucker et al. ..... 292/336.3
7,029,042 B2 * 4/2006 Belchine, III ..... 292/336.3
7,163,240 B2 * 1/2007 Odahara ..... 292/347
7,481,468 B2 * 1/2009 Merideth et al. ..... 292/137
2006/0131892 A1 * 6/2006 Pereverzev ..... 292/216
2006/0237973 A1 * 10/2006 Anguila ..... 292/92
2006/0261602 A1 * 11/2006 Jankowski et al. ..... 292/216
2006/0261603 A1 * 11/2006 Cetnar et al. ..... 292/216
2007/0085349 A1 * 4/2007 Merideth et al. ..... 292/183
2008/0036219 A1 * 2/2008 Savant et al. ..... 292/336.3
2009/0044378 A1 * 2/2009 Jankowski et al. ..... 16/412

FOREIGN PATENT DOCUMENTS

EP 1 371 799 A2 12/2003

* cited by examiner

ROTARY LOCKING MECHANISM FOR OUTSIDE VEHICLE DOOR HANDLE

FIELD OF THE INVENTION

The invention relates to a handle assembly for a motor vehicle. More particularly, the invention relates to a locking device for preventing a motor vehicle door from opening when a handle portion of a handle assembly moves with acceleration above a predetermined threshold.

DESCRIPTION OF THE RELATED ART

Motor vehicles include at least one outside door handle for releasing a door latch mechanism in order to open a door. Typically, a user actuates the outside door handle by pivoting a handle portion relative to a base. The handle portion may, however, also be pivoted relative to the base when the outside door handle is exposed to a high inertia force or sheet metal buckling, such as may occur during a motor vehicle impact. This pivoting of the handle portion in response to the high inertia force or sheet metal buckling can cause inadvertent opening of the door, which is undesirable.

It is also appreciated that various components other than the outside door handle may move with acceleration above a predetermined threshold in response to an impact force, and such movement may also cause the door to open. For example, any of numerous motor vehicle doors, including side, rear, and sliding doors, can move with acceleration above a predetermined threshold during a motor vehicle impact, which causes a ratchet to release a striker so that the door opens inadvertently.

Further, a door latch is also subject to inadvertently releasing a striker when an element thereof moves with acceleration higher than a predetermined threshold as a result of an impact force. Such movement may be the result of an inertia force acting on latch elements, forced motion of an inside door handle or cable, or forced motion of the outside door handle or connecting rod.

SUMMARY OF THE INVENTION

According to one aspect of the invention, a locking device is provided for preventing a motor vehicle door from opening when a handle portion of a handle assembly moves with acceleration above a predetermined threshold. The locking device includes a lock cup fixedly secured to the base and having a plurality of teeth. The locking device also includes a spool rotatably coupled to the lock cup and operably connected to the handle portion. The spool includes a pawl rotatably mounted thereto. The locking device further includes an inertia element disposed between the lock cup and the spool. The inertia element is coupled to the pawl such that upon the acceleration above the pre-determined threshold the inertia element lags rotation of the spool and forces the pawl into engagement with one of the plurality of teeth to stop pivotal movement of the handle portion relative to the base and prevent the door from opening.

According to another aspect of the invention, a locking device is provided for preventing a fork, which is rotatably mounted to a base, from releasing a bolt when a door moves with acceleration above a predetermined threshold. The locking device includes a plurality of teeth fixedly secured to the base adjacent the fork. The locking device also includes a pawl rotatably mounted to the fork and having an engaging portion. The locking device further includes an inertia element rotatably coupled to the pawl such that upon the acceleration of the door above the predetermined threshold the inertia element causes the engaging portion of the pawl to engage one of the plurality of teeth to prevent the fork from releasing the bolt.

According to yet another aspect of the invention, a locking device is provided for preventing a motor vehicle door from opening when a portion of a main door latch moves with acceleration above a predetermined threshold relative to a base thereof. The locking device includes a plurality of teeth fixedly secured to the base. A pawl is rotatably coupled to the portion of the main door latch. An inertia element is rotatably coupled to the pawl such that upon acceleration above the predetermined threshold the inertia element lags rotation of the portion of the main door latch to stop movement of the portion of the main door latch relative to the base and prevent the door from opening.

BRIEF DESCRIPTION OF THE DRAWINGS

Advantages of the present invention will be readily appreciated as the same becomes understood by reference to the following detailed description when considered in connection with the accompanying drawings wherein.

DETAILED DESCRIPTION OF THE PREFERRED EMBODIMENT

Figure 1:
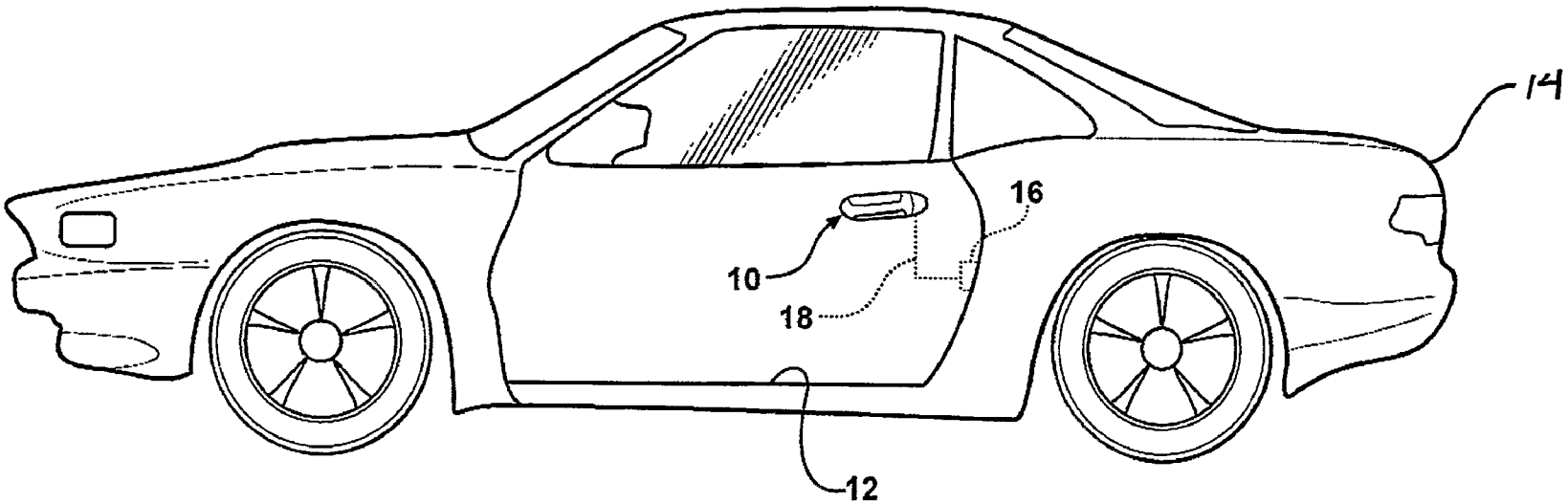
FIG. 1 is a side view of a motor vehicle including a handle assembly.

Referring to FIG. 1, a handle assembly, generally indicated at 10, is mounted along a door 12 of a motor vehicle 14. The handle assembly 10 is operatively connected to a door latch mechanism 16 by a rod 18. When the door latch mechanism 16 is unlocked, the handle assembly 10 may be actuated from outside the motor vehicle 14 to release the door latch mechanism 16 and open the door 12.

Figure 2:
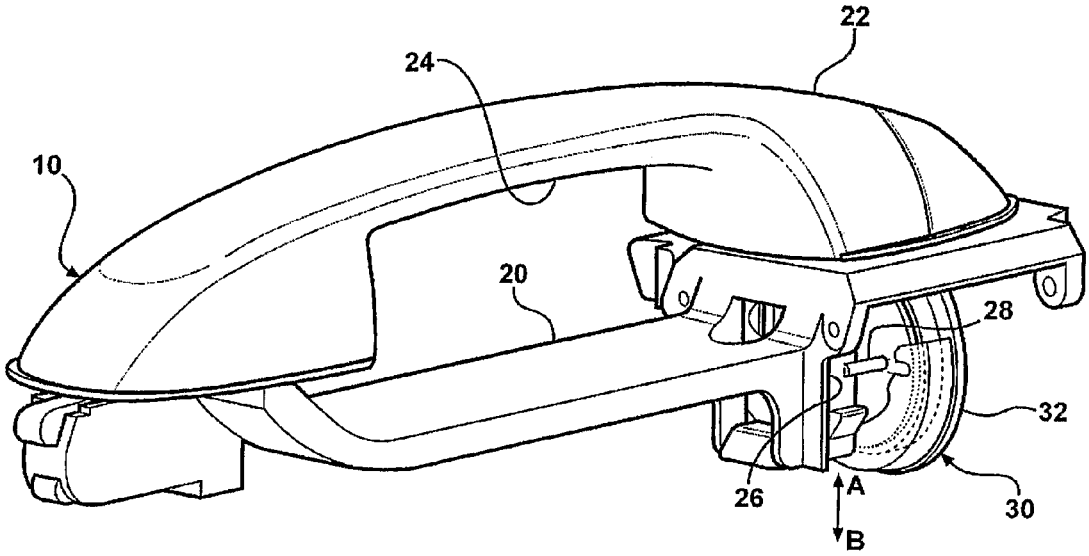
FIG. 2 is a perspective view of the handle assembly including a locking device according to a first embodiment of the invention.
Figure 3:
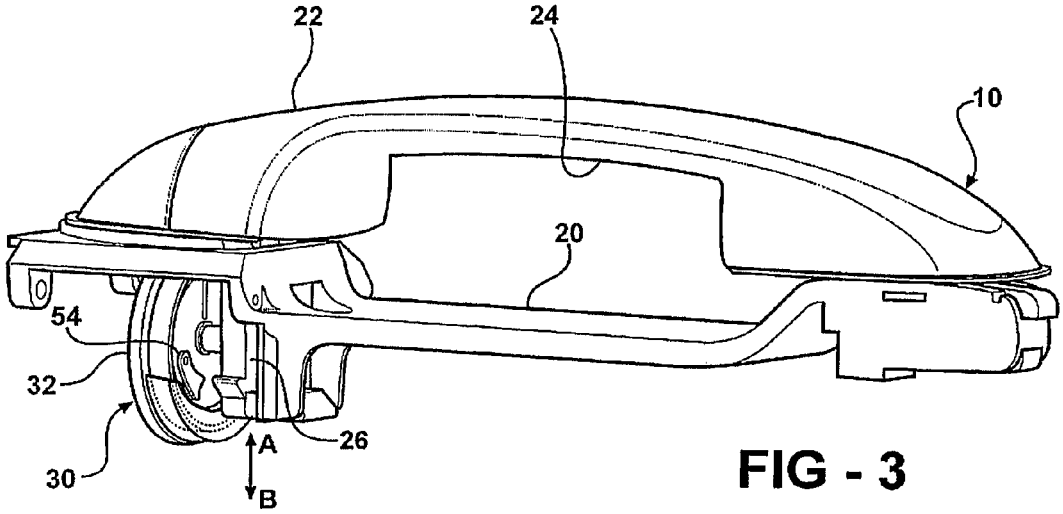
FIG. 3 is an opposing perspective view of the handle assembly including the locking device.

Referring to FIGS. 2 and 3, the handle assembly 10 includes a base 20 adapted to be fixedly secured to the door 12. A handle portion 22 is pivotally coupled to the base 20. The handle portion 22 includes a grip 24 that is manually grasped by a user for pivoting the handle portion 22 relative to the base 20 in order to actuate the handle assembly 10.

The handle assembly 10 also includes a handle lever 26 extending out from the handle portion 22. The handle lever 26 moves axially towards and away from the base 20, in the direction of arrows A and B, as the handle portion 22 is pivoted relative to the base 20. The handle lever 26 is also operably connected to the door latch mechanism 16. More specifically, the movement of the handle lever 26 in the direction of arrow A as the handle portion 22 is pivoted releases the door latch mechanism 16. A pin 28 extends outwardly from the handle lever 26 and moves axially therewith in the direction of arrows A and B as the handle portion 22 is pivoted relative to the base 20. The pin 28 terminates at a distal end 29, as shown in FIG. 4.

Referring now to FIGS. 2 through 5, a rotary catch or locking device, generally indicated at 30, is provided for preventing inadvertent release of the door latch mechanism 16 when an impact originated force causes the handle portion 22 to move with acceleration above a predetermined threshold relative to the base 20. The locking device 30 includes a lock cup 32 fixedly secured to the base 20. In a preferred embodiment, the lock cup 32 is generally cylindrical. It is, however, appreciated that the particular shape of the lock cup 32 may vary.

Figure 4:
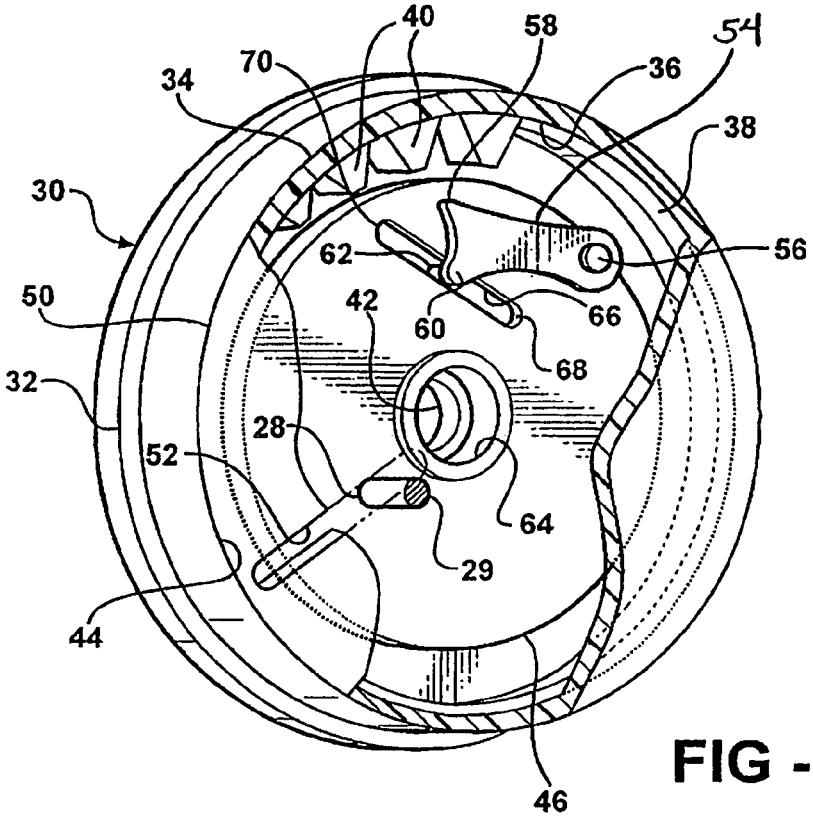
FIG. 4 is a perspective view, partially cut-away, of the locking device including a lock cup, spool and inertia disc.

Referring specifically to FIG. 4, the lock cup 32 includes a peripheral wall 34 defining an opening 36. The peripheral wall 34 includes an inner surface 38 having a plurality of teeth 40 positioned therealong. In the preferred embodiment, the peripheral wall 34 is circular, thereby creating a circle-shaped opening 36. It is, however, appreciated that the particular shape of the peripheral wall 34 may vary. The lock cup 32 further includes a center bore 42.

Figure 5:
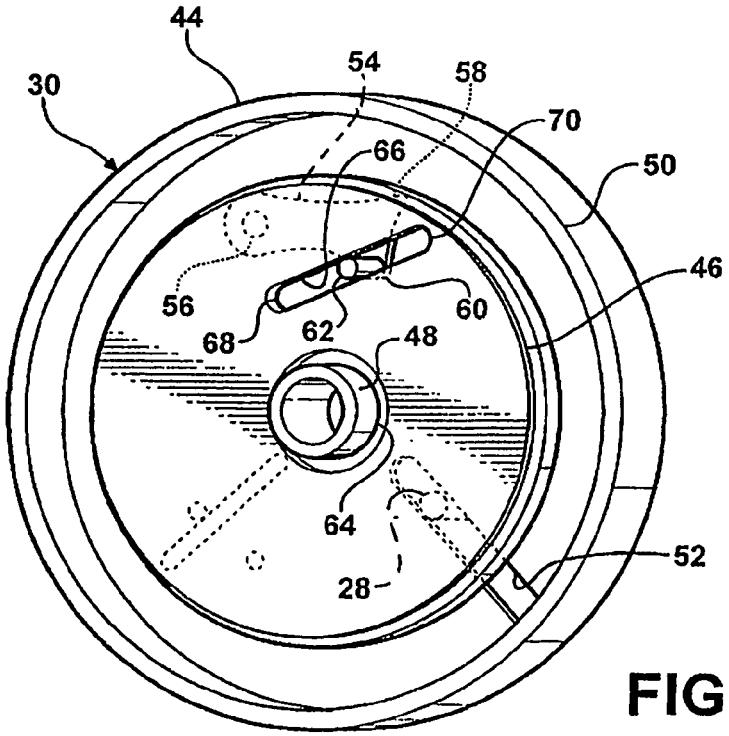
FIG. 5 is a perspective view of the spool with the inertia disc coupled thereto.

Referring now to FIGS. 4 and 5, the locking device 30 also includes a spool 44. The spool 44 has a central hub 48 that is disposed within the center bore 42 of the lock cup 32 to allow for rotation of the spool 44 relative thereto. The spool 44 also includes an annular wall 50 that fits around the peripheral wall 34 of the lock cup 32. The spool 44 further includes a slot 52 for receiving the pin 28 extending out from the handle lever 26.

Figure 7:
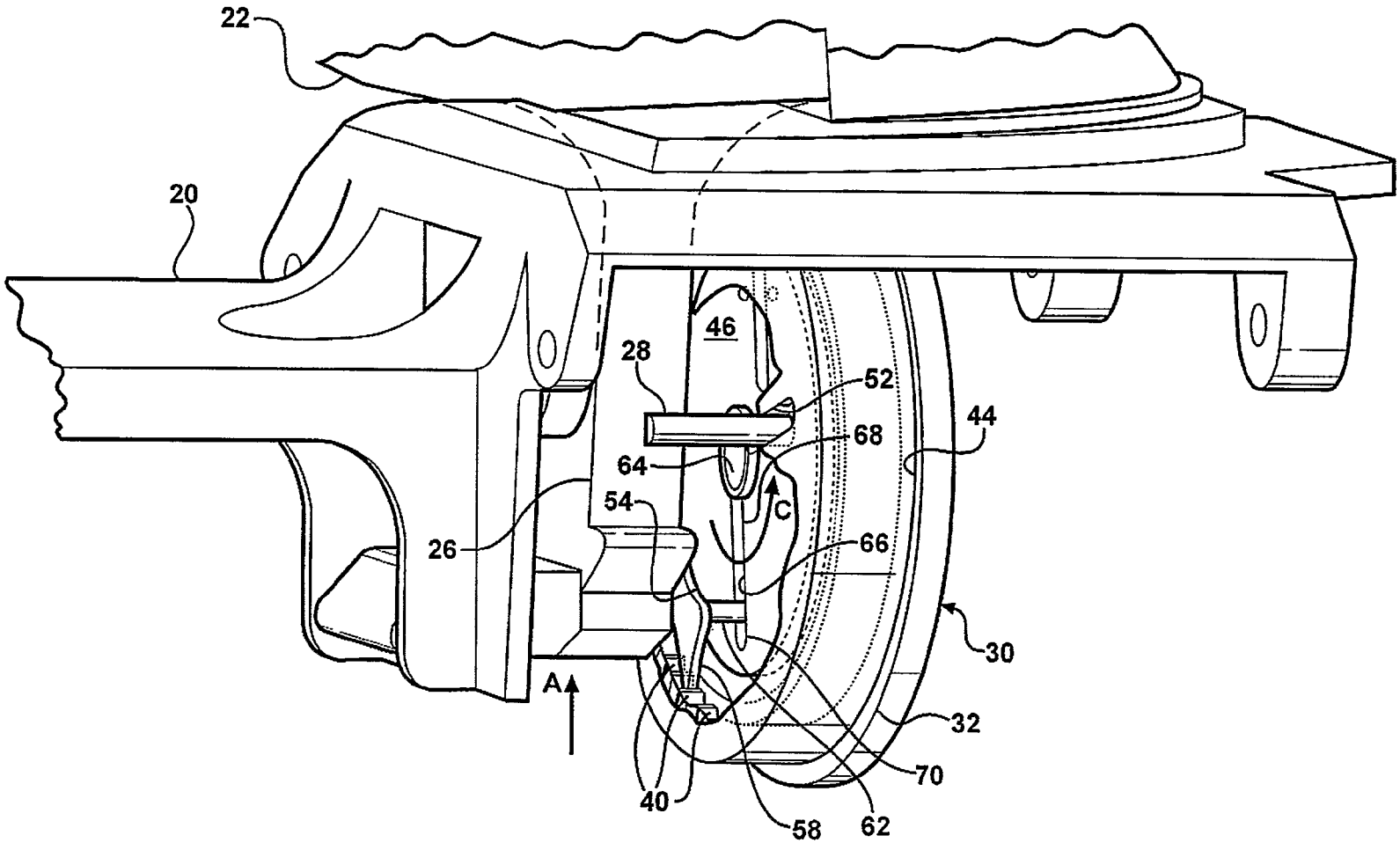
FIG. 7 is a fragmentary, perspective view of the handle assembly with a pawl engaging a plurality of teeth along the lock cup.

When the handle portion 22 is pivoted away from the base 20, the handle lever 26, and the pin 28 extending outwardly therefrom, move axially towards the base 20 in the direction of arrow A, as shown in FIG. 7. The axial movement of the pin 28 urges the spool 44 to rotate counterclockwise in the direction of arrow C, as shown in FIG. 7, relative to the lock cup 32. Thus, the axial movement of the handle lever 26 is translated into rotational movement of the spool 44.

Referring once again to FIGS. 4 and 5, a pawl 54 is rotatably mounted to the spool 44 by a mounting pin 56. The pawl 54 includes an engaging portion 58 and a coupling portion 60. A pawl pin 62 extends out from the coupling portion 60.

The locking device 30 further includes an inertia element 46. Preferably, the inertia element 46 is an inertia disc. It is, however, appreciated that the inertia element 46 may have any one of various shapes. The inertia disc 46 is disposed between the lock cup 32 and the spool 44. More specifically, the inertia disc 46 is sized to fit inside the opening 36 defined by the peripheral wall 34 of the lock cup 32.

The inertia disc 46 also includes a central aperture 64 for receiving the central hub 48 of the spool 44 therethrough. Thus, the inertia disc 46 is able to rotate with the spool 44 relative to the lock cup 32 when the handle portion 22 is pivoted relative to the base 20. During normal operation, i.e., when the handle portion 22 is actuated by a user, the inertia disc 46 and the spool 44 rotate simultaneously. By contrast, when the handle portion 22 moves with acceleration above the predetermined threshold, such as may occur during a motor vehicle impact, rotation of the inertia disc 46 lags behind the rotation of the spool 44.

The inertia disc 46 further includes an elongated slot 66 having first 68 and second 70 ends. The pawl pin 62 is received within the elongated slot 66 and is movable between first 68 and second 70 ends thereof. More specifically, when the handle portion 22 moves with acceleration above the predetermined threshold, the pawl pin 62 moves towards the second end 70 of the elongated slot 66, as shown in FIG. 7, thereby urging the engaging portion 58 of the pawl 54 into engagement with one of the plurality of teeth 40 along the peripheral wall 34 of the lock cup 32. As a result of this engagement, rotation of the spool 44 relative to the lock cup 32 is stopped, thereby blocking further axial movement of the pin 28. Thus, the handle portion 22 is prevented from fully pivoting relative to the base 20 and releasing the door latch mechanism 16. As a result, the door 12 will not open.

Figure 6:
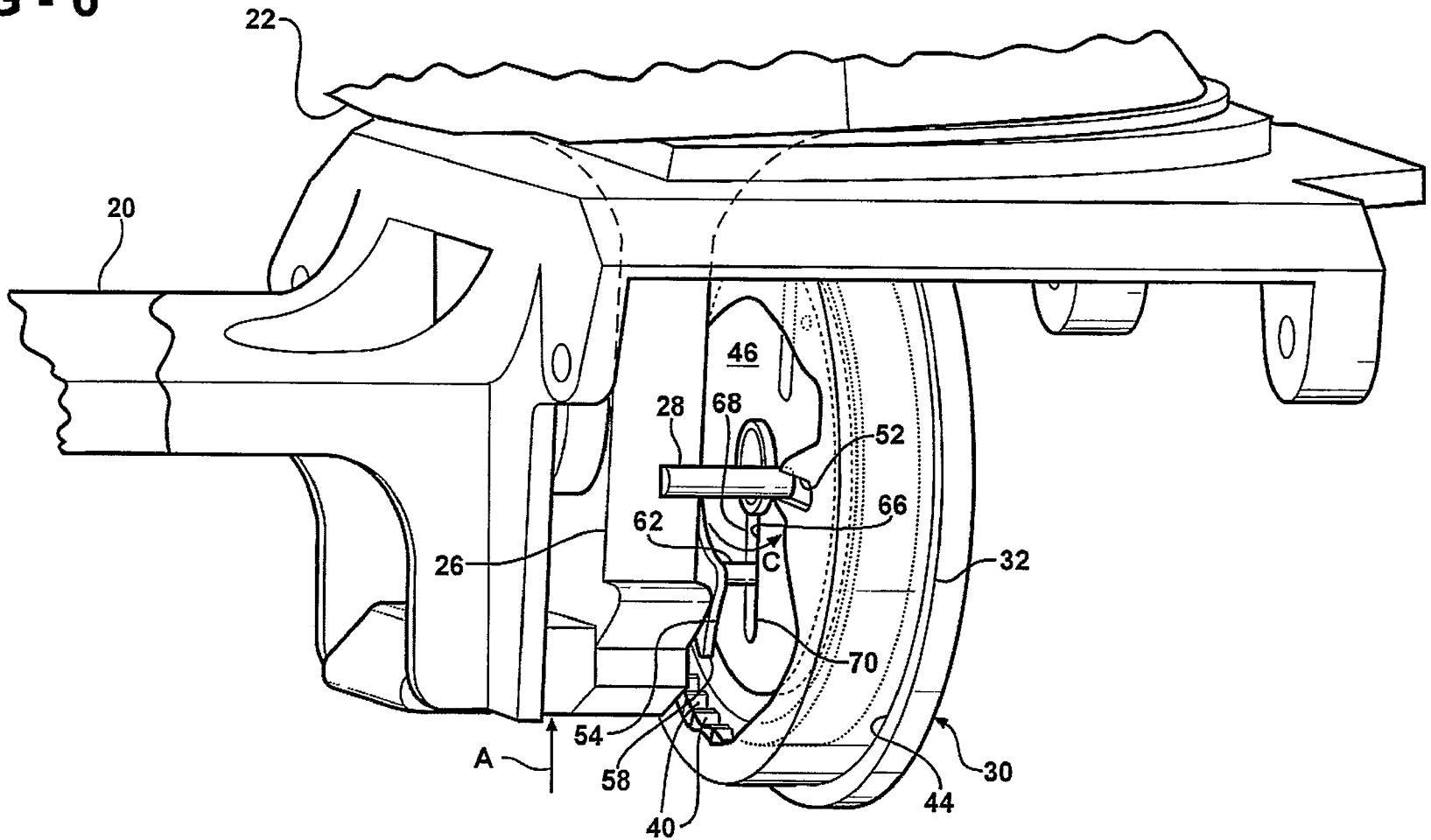
FIG. 6 is fragmentary, perspective view of the handle assembly including the locking device.

In operation, when the handle assembly 10 moves with acceleration below the predetermined threshold, such as would occur during normal operation when a user actuates the handle assembly 10 by pivoting the handle portion 22 relative to the base 20, the handle portion 22 will fully pivot relative to the base 20 to release the door latch mechanism 16 and open the door 14. In such a situation, the pivoting of the handle portion 22 relative to the base 20 causes the handle lever 26, and the pin 28 extending therefrom, to move axially in the direction of arrow A, as shown in FIG. 6. As the pin 28 moves axially, it urges the spool 44 to rotate counterclockwise in the direction of arrow C, when viewed from FIG. 6. The inertia disc 46 simultaneously rotates with the spool 44 in the counterclockwise direction. Because of the simultaneous rotation of the spool 44 and inertia disc 46, the pawl pin 62 does not move towards the second end 70 of the elongated slot 66, and the engaging portion 58 of the pawl 54 does not engage the plurality of teeth 40. As a result, the handle lever 26 moves axially until the handle portion 22 stops pivoting relative to the base 20, at which time the door latch mechanism 16 is released in order to open the door 12.

On the other hand, when an impact originated force causes the handle assembly 10 to move with acceleration above the predetermined threshold, the handle portion 22 will begin to pivot relative to the base 20. As a result, the handle lever 26 and the pin 28 move axially towards the base 20 in the direction of arrow A, as shown in FIG. 7. As the pin 28 moves axially, it urges the spool 44 to rotate counterclockwise, when viewed from FIG. 7, in the direction of arrow C. The rotation of the inertia disc 46 lags, however, behind the rotation of the spool 44. Due to relative rotation of the inertia disc 46 with respect to the spool 44, the pawl pin 62 moves towards the second end 70 of the elongated slot 66 and, as a result, the engaging portion 58 of the pawl 54 engages one of the plurality of teeth 40. When the pawl 54 engages one of the plurality of teeth 40, the rotation of the spool 44 is stopped. As a result, further axial movement of the handle lever 26 in the direction of arrow A is prevented and the handle portion 22 can no longer be pivoted relative to the base 20. Consequently, the door latch mechanism 16 is not released and the door 12 does not open.

Figure 8:
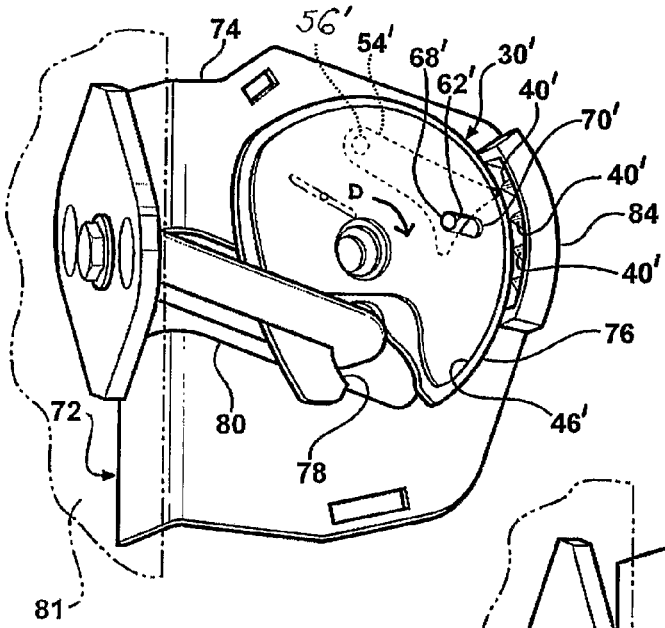
FIG. 8 is a perspective view of a door locking mechanism including a locking device according to a second embodiment of the invention.
Figure 9:
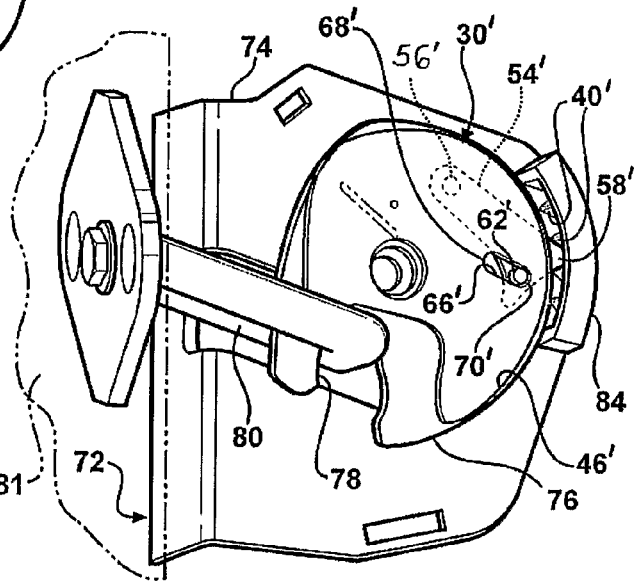
FIG. 9 is a perspective view of the door locking mechanism including the locking device having a pawl engaging one of a plurality of teeth to retain a fork in a locked position.
Figure 10:
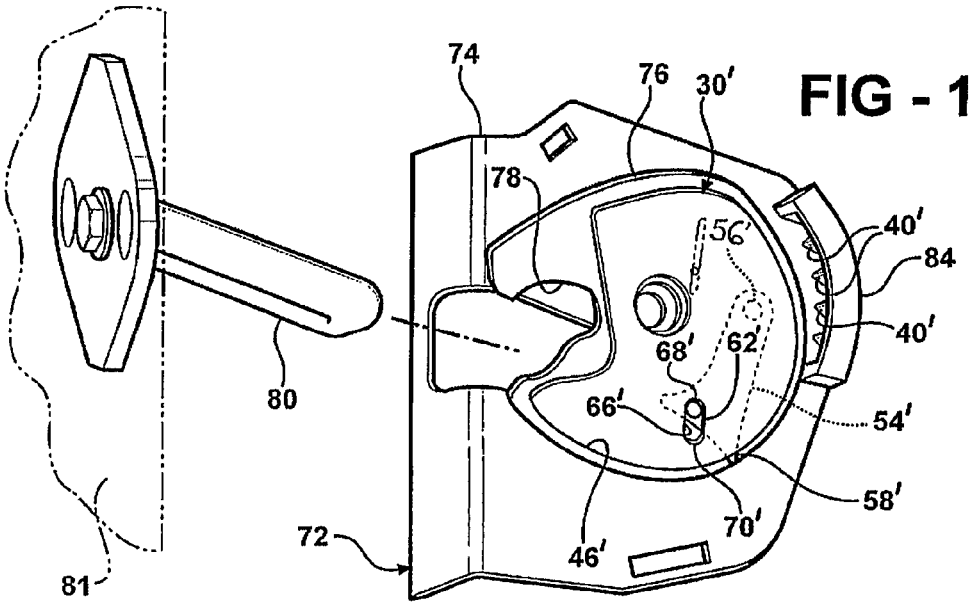
FIG. 10 is a perspective view of the door locking mechanism including the fork in an unlocked position for releasing a bolt.

Referring to FIGS. 8 through 10, wherein like primed reference numerals represent similar elements as those described above, the locking device 30' according to a second embodiment is incorporated into a door locking mechanism, generally indicated at 72. The door locking mechanism 72, which can be associated with a side door, a sliding door, or a rear door, includes a base 74 for mounting to a door of a motor vehicle. A fork 76 is rotatably mounted to the base 74 for movement between a latched position, shown in FIGS. 8 and 9, and an unlatched position, shown in FIG. 10. The fork 76 includes a recess 78 for receiving a bolt 80, which is fixedly mounted along a motor vehicle body 81. A spring (not shown) biases the fork 76 into the unlatched position.

The locking device 30' includes the plurality of teeth 40', the inertia element 46', and the pawl 54'. The plurality of teeth 40' is disposed along the base 74 adjacent the fork 76. Preferably, a generally arcuate member 84 is fixedly secured to the base 74 and includes the plurality of teeth 40' extending along a lower portion. The inertia element 46' preferably has an irregular shape that generally corresponds to the shape of the fork 76. It is, however, appreciated that the particular shape of the inertia element 46' may vary.

The pawl 54' is disposed between the inertia element 46' and the fork 76. More specifically, the pawl 54' is rotatably mounted to the fork 76 by the pin 56'. The pawl pin 62' extending outwards from the opposing end of the pawl 54' is received within the elongated slot 66' of the inertia element 46'. The pawl pin 62' moves between the first 68' and second 70' ends of the elongated slot 66' when the inertia element 46' rotates with respect to the fork 76.

In operation, when the door is opened in a typical manner by a user (so that the relative acceleration between the door locking mechanism 72 and the bolt 80 is below the predetermined threshold), the fork 76 rotates clockwise relative to the base 74 in the direction of arrow D, shown in FIG. 8. The inertia element 46' simultaneously rotates with the fork 76 until the fork 76 reaches its unlatched position, shown in FIG. 9. When the fork 76 is in the unlatched position, the bolt 80 is released to allow the door to open.

On the other hand, when the relative acceleration between the door locking mechanism 72 and the bolt 80 is above the pre-determined threshold, such as may occur during a motor vehicle impact, the rotation of the inertia element 46' in the direction of arrow D, shown in FIG. 8, will lag behind that of the fork 76 so that the pawl pin 62' moves toward the second end 70' of the elongated slot 66' and the engaging portion 58' of the pawl 54' engages one of the plurality of teeth 40', as shown in FIG. 10. When the pawl 54' engages one of the plurality of teeth 40', further clockwise rotation of the fork 76 in the direction of arrow D is prevented. As a result, the fork 76 remains in the latched position retaining the bolt 80.

Figure 11:
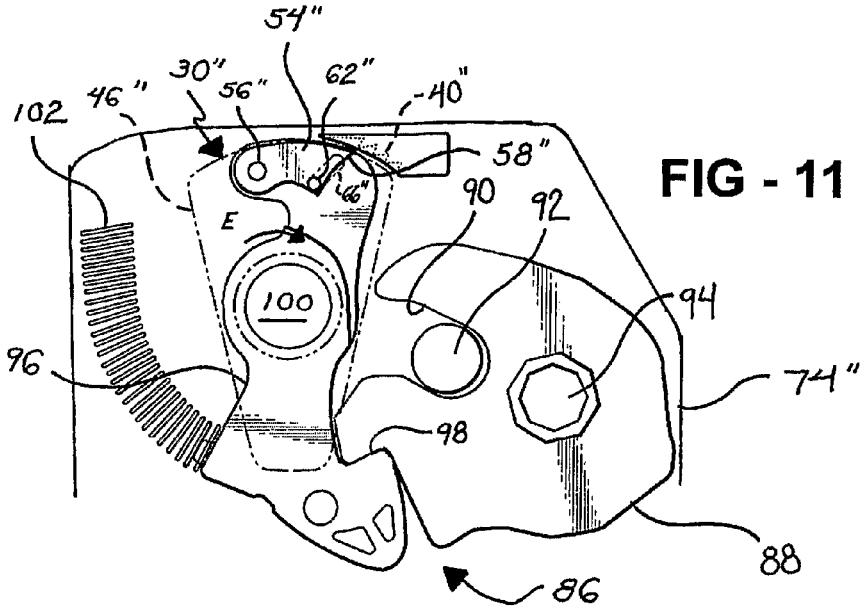
FIG. 11 is a side view of a main door latch including a locking device according to a third embodiment of the invention for selectively preventing a latch pawl from releasing a ratchet.
Figure 12:
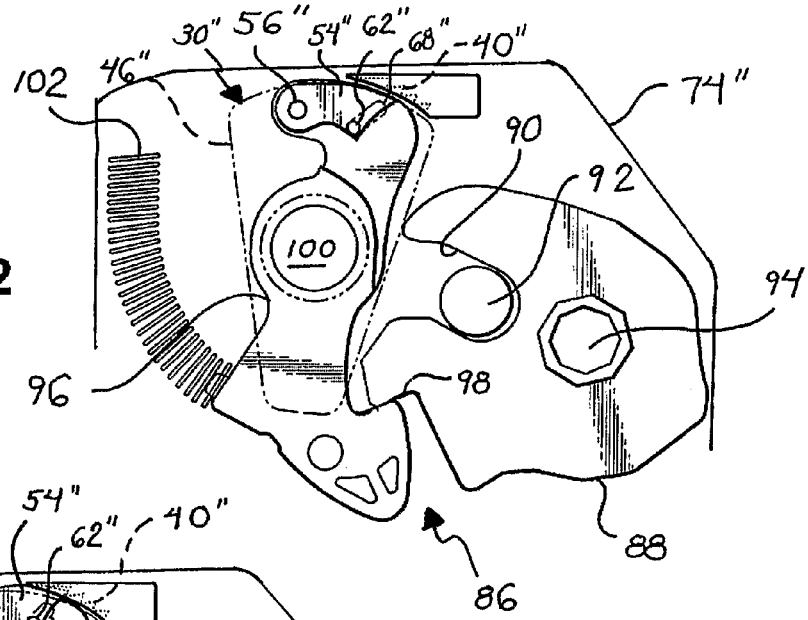
FIG. 12 is a side view of the main door latch including a pawl of the locking device clearing a plurality of teeth to allow rotation of the latch pawl in order to release the ratchet.
Figure 13:
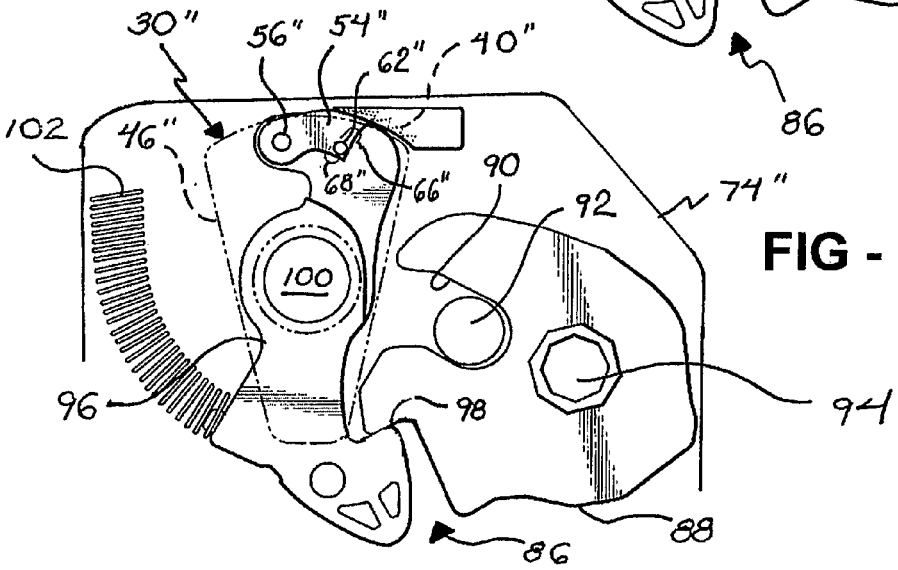
FIG. 13 is a side view of the main door latch including the pawl engaging one of the plurality of teeth to prevent the latch pawl from releasing the ratchet.

Referring to FIGS. 11 through 13, wherein like double primed reference numerals represent similar elements as those described above, the locking device 30" according to a third embodiment can be utilized with a main door latch, generally shown at 86. The main door latch 86 includes a ratchet 88 having a notch 90 for selectively retaining a striker 92. The ratchet 88 is rotatably mounted about a pivot 94.

The main door latch 86 also includes a latch pawl 96, which selectively engages a detent surface 98 of the ratchet 88 to maintain the ratchet 88 in a latched position retaining the striker 92. The latch pawl 96 is rotatably mounted about a pivot pin 100 and is biased into engagement with the ratchet 88 by a spring 102. Inside and outside release handles (both not shown) are operably connected to the latch pawl 96 via a cable or rod. Actuation of one of the inside and outside release handles urges the latch pawl 96 against the bias of the spring 102 and out of engagement with the ratchet 88 in order to release the striker 92.

In the current embodiment, the inertia element 46" is generally wedge-shaped and is rotatably mounted about the pivot pin 100. The pawl 54" is disposed between the inertia element 46" and the latch pawl 96. More specifically, the pawl 54" is rotatably mounted to the latch pawl 96 by the pin 56". The pawl pin 62" extending outwards from the opposing end of the pawl 54" is received within the elongated slot 66" of the inertia element 46".

In operation, when the door 12' is opened via one of the inside and outside door handles during normal operation (so that the relative acceleration of the latch pawl 96 is below a predetermined threshold), the latch pawl 96 rotates clockwise in the direction of arrow E, as shown in FIG. 11. The inertia element 46' rotates in the direction of arrow E at approximately the same rate as the latch pawl 96 so that the pawl 54", whose pawl pin 62" remains at the first end 68" of the elongated slot 66", clears the plurality of teeth 40" disposed along the base 74", as shown in FIG. 12. Thus, the rotation of the latch pawl 96 about the pivot pin 98 is unimpeded. As a result, the ratchet 88 is allowed to rotate about the pivot pin 94 and release the striker 92 in order to allow opening of the door 12".

On the other hand, when the latch pawl 96 moves with acceleration above the pre-determined threshold, such as may occur during a motor vehicle impact, the rotation of the inertia element 46" in the direction of arrow E, shown in FIG. 11, will lag behind that of the latch pawl 96 so that the pawl pin 62" moves toward the second end 70" of the elongated slot 66" and the engaging portion 58" of the pawl 54" engages one of the plurality of teeth 40", as shown in FIG. 13. When the pawl 54" engages one of the plurality of teeth 40", further rotation of the latch pawl 96 in the direction of arrow E is prevented. As a result, the ratchet 88 remains in the latched position retaining the striker 92.

The invention has been described in an illustrative manner, and it is to be understood that the terminology, which has been used, is intended to be in the nature of words of description rather than of limitation. Many modifications and variations of the present invention are possible in light of the above teachings. It is, therefore, to be understood that within the scope of the appended claims, the invention may be practiced other than as specifically described.

What is claimed:

1. A locking device for a handle assembly of a motor vehicle door including a base and a handle portion, said locking device comprising:

a lock cup fixedly secured to the base and having a plurality of teeth;

a spool rotatably coupled to said lock cup and operably connected to the handle portion, said spool having a pawl rotatably mounted thereto, said pawl including a pawl pin extending out therefrom; and an inertia element disposed between said spool and said lock cup, said inertia element including an elongated slot extending between first and second ends and receiving said pawl pin therewithin such that upon acceleration of the handle assembly below a predetermined threshold said inertia element rotates with said spool and the handle portion moves relative to the base to allow opening of the door and upon acceleration of the handle assembly above the predetermined threshold said inertia element lags rotation of said spool and forces said pawl pin to said second end of said elongated slot to urge said pawl into engagement with one of said plurality of teeth on said lock cup to stop movement of the handle portion relative to the base and prevent the door from opening.

2. A locking device as set forth in claim 1 wherein said spool includes a slot for receiving a portion of the handle assembly therethrough to operatively connect said spool with the handle portion.

3. A locking device as set forth in claim 2 wherein said lock cup defines an opening for receiving said inertia element therein.

4. A locking device as set forth in claim 3 wherein said inertia element is a disc sized to fit within said opening of said lock cup.

5. A locking device as set forth in claim 1 wherein said pawl is disposed between said inertia element and said spool.

6. A locking device for selectively preventing a fork rotatably mounted to a base from releasing a bolt upon movement of a door, said locking device comprising:

a plurality of teeth fixedly secured to the base adjacent the fork;

a pawl rotatably mounted to the fork and having an engaging portion, said pawl including a pawl pin extending out therefrom; and an inertia element rotatably coupled to said pawl, said inertia element including an elongated slot extending between a first end and a second end and receiving said pawl pin therewithin such that upon the acceleration of the door below a predetermined threshold said inertia element simultaneously rotates with the fork to allow the fork to release the bolt and upon the acceleration of the door above the predetermined threshold rotation of said inertia element lags behind rotation of the fork such that said pawl pin moves to the second end of said elongated slot to urge said engaging portion of said pawl into engagement with one of said plurality of teeth to prevent the fork from releasing the bolt.

7. A locking device as set forth in claim 6 wherein said inertia element has a shape at least partially complementary to the fork.

8. A locking device as set forth in claim 6 wherein said pawl is disposed between said inertia element and the fork.

9. A locking device for selectively preventing a motor vehicle door from opening upon movement of a main door latch, including a latch pawl and a ratchet, relative to a base, said locking device comprising:

a plurality of teeth fixedly secured to the base;

a pawl rotatably mounted to the latch pawl, said pawl including a pawl pin extending out therefrom; and an inertia element rotatably coupled to said pawl and including an elongated slot extending between first and second ends for receiving said pawl pin therewithin such that upon acceleration of the latch pawl below a predetermined threshold said inertia element rotates simultaneously with the latch pawl and the latch pawl releases the ratchet to allow opening of the door and upon acceleration of the latch pawl above the predetermined threshold said inertia element lags rotation of the latch pawl so that said pawl pin moves to said second end of said elongated slot and said pawl engages one of said plurality of teeth to stop movement of the latch pawl and prevent the door from opening.

10. A locking device as set forth in claim 9 wherein said inertia element is wedge-shaped.

11. A locking device as set forth in claim 9 wherein said pawl is disposed between said inertia element and the latch pawl.

12. A handle assembly for actuating a door latch mechanism of a motor vehicle door, said handle assembly comprising:

a base adapted to be fixedly secured to the door;

a handle portion pivotally secured to said base and operatively connected to the door latch mechanism;

a lock cup fixedly secured to said base and having a plurality of teeth;

a spool rotatably coupled to said lock cup and operably connected to said handle portion, said spool having a pawl rotatably mounted thereto, said pawl including a projection extending out therefrom; and an inertia element disposed between said spool and said lock cup, said inertia element including an elongated slot extending between first and second ends and receiving said pawl projection therewithin such that when said handle portion moves with acceleration below a predetermined threshold said inertia element rotates with said spool and said pawl remains spaced apart from said second end of said elongated slot such that the handle portion moves relative to the base and the door latch mechanism is released and when said handle portion moves with acceleration above the predetermined threshold said inertia element lags rotation of said spool and forces said pawl projection to said second end of said elongated slot in order to move said pawl into engagement with one of said plurality of teeth to stop movement of said handle portion relative to said base and prevent the door from opening.

13. A locking device as set forth in claim 12 wherein said handle portion includes a pin extending out therefrom.

14. A locking device as set forth in claim 13 wherein said spool includes a slot for receiving said pin to operatively connect said spool with the handle portion.

15. A locking device as set forth in claim 14 wherein said lock cup defines an opening for receiving said inertia element therein.

16. A locking device as set forth in claim 15 wherein said inertia element is a disc sized to fit within said opening of said lock cup.

* * * * *